US006647842B1

(12) United States Patent
Krasik-Geiger et al.

(10) Patent No.: US 6,647,842 B1
(45) Date of Patent: Nov. 18, 2003

(54) CALIBRATED ANGLE AND DEPTH SCISSORS

(76) Inventors: Ariel Krasik-Geiger, 1849 N. 53rd St., Seattle, WA (US) 98103; Michael Krasik, 1849 N. 53rd St., Seattle, WA (US) 98103

( * ) Notice: Subject to any disclaimer, the term of this patent is extended or adjusted under 35 U.S.C. 154(b) by 0 days.

(21) Appl. No.: 10/322,219

(22) Filed: Dec. 17, 2002

Related U.S. Application Data

(62) Division of application No. 09/072,911, filed on May 4, 1998, now Pat. No. 6,513,247.

(60) Provisional application No. 60/047,910, filed on May 29, 1997.

(51) Int. Cl.[7] ..... B26B 13/22

(52) U.S. Cl. ..... 83/13; 30/233; 30/293

(58) Field of Search ..... 83/13; 30/233, 30/293, 179, 178, 177, 229, 197; 33/424, 425, 426

(56) References Cited

U.S. PATENT DOCUMENTS

| | | | | |
|---|---|---|---|---|
| 598,031 | A | 1/1898 | Steen | 30/233 |
| 736,042 | A | 8/1903 | Waters | 33/426 |
| 1,856,779 | A | 5/1932 | Montelius | 33/426 |
| 1,935,812 | A | 11/1933 | Moody | |
| 3,178,817 | A | 4/1965 | Rubinstein | 30/293 |
| 3,416,232 | A | 12/1968 | Overbay | 33/424 |
| 3,840,989 | A | 10/1974 | Hexdall | 30/231 |
| 3,885,306 | A | 5/1975 | Herman | 30/123 |
| 4,106,195 | A | 8/1978 | Berg | 30/293 |
| 4,428,124 | A | 1/1984 | Asakura | 33/334 |
| 4,776,096 | A | 10/1988 | Chang | 30/233 |
| 4,783,867 | A | 11/1988 | Tsao | 7/160 |
| 4,901,440 | A | 2/1990 | Go et al. | 30/254 |
| 5,035,054 | A | 7/1991 | Ellenberger | 30/233 |
| 5,205,045 | A | 4/1993 | Liu | 33/468 |
| 5,542,182 | A | 8/1996 | Martinez | 30/179 |
| 6,513,247 | B1 * | 2/2003 | Krasik-Geiger et al. | 30/233 |

FOREIGN PATENT DOCUMENTS

| | | |
|---|---|---|
| FR | 969731 | 5/1950 |
| GB | 9594 | 6/2002 |

* cited by examiner

*Primary Examiner*—Charles Goodman
(74) *Attorney, Agent, or Firm*—Seed IP Law Group PLLC

(57) ABSTRACT

A scissors with built-in ruler and protractor allows precision cuts to measure lengths and angles without the use of separate external measuring tools and marking devices.

1 Claim, 1 Drawing Sheet

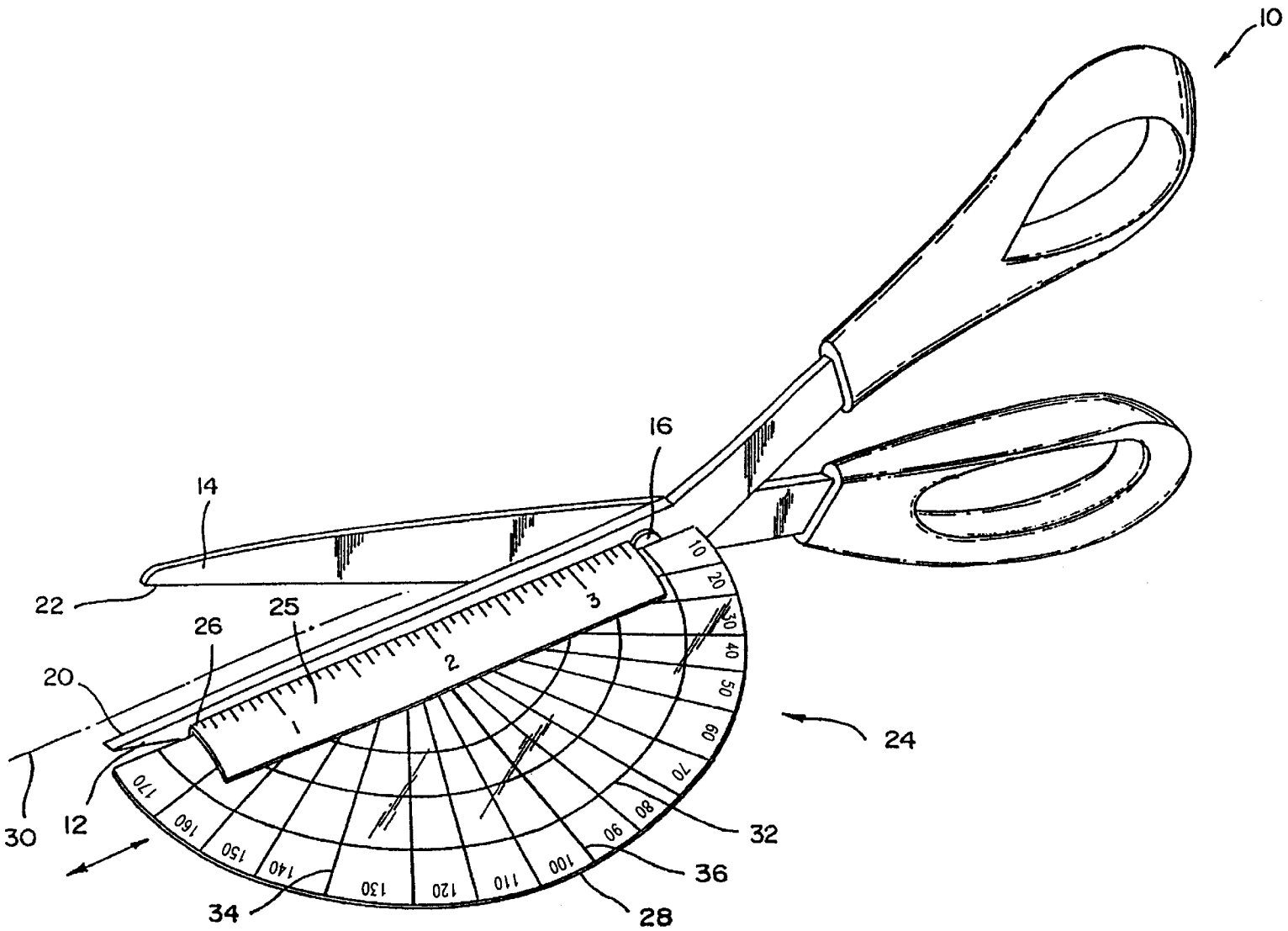
10
24
32
36
28
16
10
20
30
40
50
60
70
80
90
100
110
120
130
140
150
160
170
3
2
1
25
26
14
22
20
12
30
34

CALIBRATED ANGLE AND DEPTH SCISSORS

CROSS REFERENCE TO RELATED APPLICATIONS

This application is a divisional of U.S. patent application Ser. No. 09/072,911 entitled CALIBRATED ANGLE AND DEPTH SCISSORS filed May 4, 1998 now U.S. Pat. No. 6,513,247 by Ariel Krasik-Geiger and Michael Krasik, which in turn claims priority from corresponding provisional application Ser. No. 60/047,910 filed on May 29, 1997 by Ariel Krasik-Geiger and Michael Krasik, and claims the benefit of the filing date of said copending application.

BACKGROUND OF THE PRIOR ART

Ordinary scissors are effective for cutting material like paper or cloth but when one wishes to make a precision cut, to a certain measure depth or at a certain measured angle, other separate tools such as a ruler and protractor must be employed, along with the need to make guide marks on the material to be cut with a marking device such as a pencil.

The object of this invention is to allow a method for precision scissors cutting without the need to use other separate tools such as a ruler, protractor, and pencil. Furthermore, the object of this invention is create an improved scissors with built-in ruler and protractor functions thereby eliminating the need for a separate marking device as is commonly used with an ordinary ruler or protractor.

SUMMARY OF THE INVENTION

This tool is an improved scissors which has both a ruler and a movable protractor mounted on one of the blades of the scissors. To make a cut of a certain depth, for example 1 inch, you put the edge of the paper on top of the ruler gauge at the 1 inch mark; then you make the cut. To make a cut of a certain acute or obtuse angle, you rotate the paper you are about to cut so that the edge of the paper matches the angle line on the protractor; then you make the cut. You could also hold the edge of the paper parallel to the angle line on the protractor and then make the cut. If you want to make a cut of a certain angle that is also a specific depth of cut, you first slide the 90 degree line on the protractor to the desired depth mark on the ruler gauge. Then you slide the edge of the paper to that same depth mark and rotate the paper so that the edge of the paper matches the desired angle line on the protractor; then you make the cut.

This invention eliminates the need to use a separate marking device (pen or pencil) which is needed when using an ordinary ruler and protractor with a conventional scissors. For cutting out geometric shapes on paper, this invention saves time when compared to the conventional use of separate rules, protractors, marking devices, and scissors.

Use of this invention can involve a method of cutting wherein the paper being cut is inverted on some cuts, depending upon the direction of the cut, so as to allow the operator to always have a conventional view of the cut with the paper covering the top portion of the protractor. Other embodiments of this invention are anticipated including having similar mensuration devices attached to both blades of the scissors. This would eliminate the need to invert the paper for some cuts in certain directions.

BRIEF DESCRIPTION OF THE DRAWING

FIG. 1 is a perspective view of the present invention.

BEST MODE FOR CARRYING OUT THE INVENTION

This tool is a scissors (10) comprised of a first part (12) and a second part (14) connected by a pivot (16), first and second parts each having blade portions (20 and 22). Mounted to the first part (12) is a mensuration device generally indicated by reference numeral 24. The mensuration device (24) has a base member (26) which is attached to the first part (12) at a position between the pivot (16) and the forward tip of the first blade portion (20) mounted substantially parallel to the cutting edge of the first blade portion (20). The base member (26) has a linear scale or ruler (25) for distance measurement from the coincidental forward ends of the blade portions (20 and 22) and a protractor (28) for angle measurement relative to the long axis of the blade portions (20 and 22). The protractor (28) must be crafted such that the imaginary center point to the protractor will be coincident with the cutting edges of the blade portion (20 and 22).

The base member (26) has the means to support the protractor (28) in place substantially perpendicular to the external face of the first part (12) and on a plane substantially parallel to the plane of the paper (30) being cut. The base member (26) has the means to allow the protractor (28) to be manually repositioned along the long axis of the base member (26).

A piece of paper (30) can be inserted between the blade portions (20 and 22) and an edge of the paper can be aligned with a certain reading on the ruler (25) then cut to a length equal to the reading on the ruler (25).

A multitude of radial lines (34) on the protractor (28) at designated angles allow an edge of the paper (30) to be aligned coincident with a designated radial line to affect an angular cut on the paper (30) at that designated angle. If the ninety degree radial line (36) is positioned to match a certain reading on the ruler (25) the resulting length of the cut at the designated angle will equal the reading on the ruler (25).

If the edge of the paper (30) is aligned parallel to but not coincident with a certain radial line (34) the resulting cut will be at an angle equal to the angle of that certain radial line but with an uncalibrated length of cut. Concentric circular lines (32) are marked on the protractor (28) at various radii for the purpose of cutting at a known measured distance from an edge of the paper (30).

The base (26) can be mounted to the first part (12) in a variety of ways including permanent affixing or temporary affixing with magnets or other non-permanent means. Temporary affixing allows retrofitability to many existing conventional scissors. Other methods of affixing for the base (26) are anticipated including a base (26) which is a fully integrated non-separate part of a first part (12 of the scissors (10).

The improved scissors (10) can be used in a method of teaching various skills to students wherein the instructor will write or verbally call out cutting instructions and students who follow the instructions properly will properly cut out a predetermined shape.

The improved scissors (10) can be used in a method of teaching various skills to students by requiring students to cut out predetermined shapes with certain dimensions without using separate measuring tools or marking devices.

We claim:

1. A method for making a calibrated angle and depth cut in a sheet of material having a substantially straight edge, comprising the steps of:

positioning a calibrated angle and depth measuring scissors device adjacent to the straight edge of the sheet material;

opening blades of the scissors device and inserting the sheet into the opening;

advancing the blades to a desired depth coincident with linear depth markings on one of the blades;

aligning the edge of the sheet so as to be parallel to one of a plurality of radial angle mensuration markings on a angle mensuration device connected to the scissors device; and, closing the blades.

* * * * *